US005080988A

United States Patent [19]

Germain et al.

[11] Patent Number: 5,080,988

[45] Date of Patent: Jan. 14, 1992

[54] BIASING SCHEME FOR IMPROVING LATITUDES IN THE TRI-LEVEL XEROGRAPHIC PROCESS

[75] Inventors: Richard P. Germain, Webster; James E. Williams, Rochester, both of N.Y.

[73] Assignee: Xerox Corporation, Stamford, Conn.

[21] Appl. No.: 440,913

[22] Filed: Nov. 22, 1989

[51] Int. Cl.[5] ..... G03G 13/06; G03G 13/08; G03G 13/01

[52] U.S. Cl. ..... 430/54; 435/42; 435/45; 355/265; 355/266; 355/328

[58] Field of Search ..... 430/42, 45, 54; 355/265, 266, 328

[56] References Cited

U.S. PATENT DOCUMENTS

| | | | |
|---|---|---|---|
| 4,078,929 | 3/1978 | Gundlack . | |
| 4,632,054 | 12/1986 | Whittaker et al. | 118/657 |
| 4,761,668 | 8/1988 | Parker et al. | 430/125 X |
| 4,761,672 | 8/1988 | Parker et al. | 430/42 |
| 4,771,314 | 9/1988 | Parker et al. | 430/42 |
| 4,811,046 | 3/1989 | May | 430/45 |
| 4,833,504 | 5/1989 | Parker et al. | 355/326 |
| 4,847,655 | 7/1989 | Parker et al. | 355/210 |
| 4,868,611 | 9/1989 | Germain | 355/328 |
| 4,998,139 | 3/1991 | May et al. | 355/328 X |

FOREIGN PATENT DOCUMENTS

| | | | |
|---|---|---|---|
| 138439 | 10/1979 | Japan | 430/42 |

*Primary Examiner*—Roland Martin

[57] ABSTRACT

The operating latitude of the tri-level xerographic process is improved by replacing the standard DC bias that is applied to one or both of the developer housings in conventional tri-level imaging with a chopped DC (CDC) developer bias. Chopped DC biasing is the alternate application of two discrete bias voltages to a developer stucture in a periodic fashion at a given frequency, with the period of each cycle divided up between the two bias levels at a duty cycle of from 5%-10% or 90%-95% depending upon which of the two developer structures is being biased. In the case of the DAD developer structure the duty cycle of higher of the two biases is 5%-10% and in case of a CAD developer structure the duty cycle of higher of the two biases is 90%-95%.

9 Claims, 3 Drawing Sheets

BIASING SCHEME FOR IMPROVING LATITUDES IN THE TRI-LEVEL XEROGRAPHIC PROCESS

BACKGROUND OF THE INVENTION

This invention relates generally improved latitude in xerographic imaging wherein latent electrostatic images are rendered visible using one or more colors of dry toner or developer and, more particularly, to developer biasing for improving the latitude of tri-level xerographic imaging.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developer image is then fixed to the imaging surface or is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one change. In yet another embodiment, the development system is biased to about the background voltage. Such biasing results in a developed image of improved color sharpness.

In tri-level xerography, the xerography contrast on the charge retentive surface or photoreceptor is divided three, rather than two, ways as is the case in conventional xerography. The photoreceptor is charged, typically is 900 v. It is exposed imagewise, such that one image corresponding to charged image areas (which are subsequently developed by charged area development, i.e. CAD) stays at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100 v) which corresponds to discharged area images that are subsequently developed by discharged-area development (DAD). The background areas exposed such as to reduce the photoreceptor potential to halfway between the $V_{cad}$ and $V_{dad}$ potentials, (typically 500 v) and is referred to as $V_w$ or $V_{white}$. The CAD developer is typically biased about 100 v closer to $V_{cad}$ than $V_{white}$ (about 600 v), and the DAD developer system is biased about 100v closer to $V_{dad}$ than $V_{white}$ (about 400 v).

Because the composite image developed on the charge retentive surface consists of both positive and negative toner a pre-transfer corona charging step is necessary to bring all the toner to a common polarity so it can be transferred using corona charge of the opposite polarity.

Various techniques have heretofore been employed to develop electrostatic images as illustrated by the following disclosures which may be relevant to certain aspects of the present invention.

U.S. Pat. No. 4,761,668 granted to Parker et al and assigned to the same assignee as the instant application which relates to tri-level printing discloses apparatus for minimizing the contamination of one dry toner or developer by another dry toner or developer used for rendering visible latent electrostatic images formed on a change retentive surface such as a photoconductive imaging member. The apparatus causes the otherwise contaminating dry toner or developer to be attracted to the charge retentive surface in its inner-document and outboard areas. The dry toner or developer so attracted is subsequently removed from the imaging member at the cleaning station.

U.S. Pat. No. 4,761,672 granted to Parker et al and assigned to the same assignee as the instant application which relates to tri-level printing discloses apparatus wherein transient development conditions that occur during start-up and shut-down in a tri-level xerographic system when the developer biases are either actuated or deactuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and development characteristics, the charging of the photoreceptor can be varied in accordance with the change of developer bias voltage.

U.S. Pat. No. 4,811,046 granted to Jerome E. May and assigned to the same assignee as the instant application which relates to tri-level printing discloses apparatus wherein undesirable transient development conditions that occur during start-up and shut-down in a tri-level xerographic system when the developer biases are either actuated or deactuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact-prevention detection to permit use of the tri-level system to be utilized as a single color system or for the purpose of agitating developer in only one of the housings at a time to insure internal triboelectric equilibrium of the developer in that housing.

U.S. Pat. No. 4,771,314 granted to Parker et al and assigned to the same assignee as the instant application which relates to tri-level printing discloses printing apparatus for forming toner images in black and at least one highlighting color in a single pass of a charge retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. Pat. No. 4,632,054 granted to Whittaker et al on Dec. 30, 1986 and assigned to the same assignee as the present invention discloses a development system comprising an operator adjustable voltage source coupled to a marking particle transport roll to electrically bias the roll to at least either a first electrical potential or to a second electrical potential. A second transport roll is electrically biased to a fixed potential.

U.S. Pat. No. 4,833,504 granted to Parker and assigned to the same assignee as the instant application which relates to tri-level printing discloses a magnetic developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complementary half of a tri-level latent image while at the same time allowing the already developed first half to pass through the second housing with minimum image disturbance.

U.S. patent application Ser. No. 220,408 filed on June 28, 1988 in the name of Parker et al, now U.S. Pat. No. 4,901,114, and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

The problem of fringe field development in a tri-level highlight color, single pass imaging system is addressed in U.S. Pat. No. 4,847,655 assigned to the same assignee as the instant invention and granted to Parker et al on July 11, 1989. In this application there is disclosed a magnetic brush developer apparatus comprising a plurality of developer housings each including a plurality of magnetic brush rolls associated therewith. Conductive magnetic brush (CMB) developer is provided in each of the developer housings. The CMB developer is used to develop electronically formed images. The developer conductivity, as measured in a powder electrical conductivity cell, is in the range of 10.9 to 10.13 (ohm-cm)−1. The toner concentration of the developer is in the order of 2.0 to 3.0% by weight and the toner charge level is less than 20 microcoulombs/gram and the developer rolls are spaced from the charge retentive surface a distance in the order of 0.40 to 0.120 inch.

U.S. Pat. No. 4,868,611 granted on Sept. 9, 1989 to Richard P. Germain and assigned to the same assignee as the instant invention discloses a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

U.S. patent application Ser. No. 440,914, assigned to the same assignee as the instant application and filed in the USPTO in the name of James E. Williams on the same day discloses the use of Chopped DC biases applied to developer structures in the tri-level highlight color mode of operation. A monochrome black mode of operation is also disclosed wherein only the black developer structure is employed with a standard DC bias applied thereto.

Since tri-level xerography, as noted hereinabove, requires the development of the two images within the same voltage space that is normally used for one image in standard bi-level xerography the effective development and cleaning fields available in tri-level are about half that of normal xerography. These lower fields make it more difficult to develop enough toner on the photographer latent image in order to obtain acceptable output densities on paper, while still maintaining acceptable background suppression. While tri-level xerography can achieve sufficient development of both colors with acceptable background, the reduced operating latitudes (as compared to bi-level monochrome xerography) require that process parameters such as toner concentration (TC) and photoreceptor electrostatics be carefully controlled, and that the available voltage space of the photoreceptor be maximized (resulting in lower photoreceptor life). As will be appreciated, wider operating latitudes in tri-level highlight color imaging are most desirable.

BRIEF SUMMARY OF THE INVENTION

In accordance with the present invention, the operating latitude of the tri-level xerographic process is improved by replacing the standard DC bias that is applied to one or both of the developer housings in conventional tri-level imaging with a chopped DC (CDC) developer bias. By chopped DC bias is meant that the housing bias applied to the developer housing is alternated between two potentials, one that represents roughly the normal bias for the DAD developer, and the other that represents a bias that is considerably more negative than the normal bias, the former being identified as $V_{Bias}$ Low and the latter as $V_{Bias}$ High. This alternation of the bias takes place in a periodic fashion at a given frequency, with the period of each cycle divided up between the two bias levels at a duty cycle of from 5–10% (Percent of cycle at $V_{BIAS}$ High). In the case of the CAD image, the amplitude of both $V_{BIAS}$ LOW and $V_{BIAS}$ High are about the same as for the DAD housing case, but the waveform is inverted in the sense that the the bias on the CAD housing is at $V_{BIAS}$ High for a duty cycle of 90–95%.

We have found that several benefits are associated with this type of biasing:

Increased developed mass/area (DMA) for a given background level.

An increase in developed charge/mass (Q/M), which reduces the amount of color image damage caused by the second CAD black developer housing.

A consistent increase of 25–40 volts in the development neutralization of both the DAD and CAD latent images.

The increases in the DMA and Q/M when using a Chopped DC bias, and the resultant increase in image neutralization, is used to improve the operating latitude in several different ways. The increased developability that is obtained when using the Chopped DC bias instead of an equivalent conventional DC bias can be used to either obtain higher DMA's for the same background level, or to obtain the same DMA as the DC bias case, but with reduced development fields. The reduced development fields in the latter case would make available photoreceptor voltage that could be applied elsewhere (i.e: red and black cleaning fields, or reduction of photoreceptor voltages). The higher developed Q/M helps to decrease the amount of red image damage caused by the second CAD black housing. The increased neutralization helps to prevent the development of black carrier beads and wrong sign toner into the first (DAD) image by the second (CAD) developer housing.

DETAILED DESCRIPTION OF THE PREFERRED EMBODIMENT OF THE INVENTION

Figure 1A:
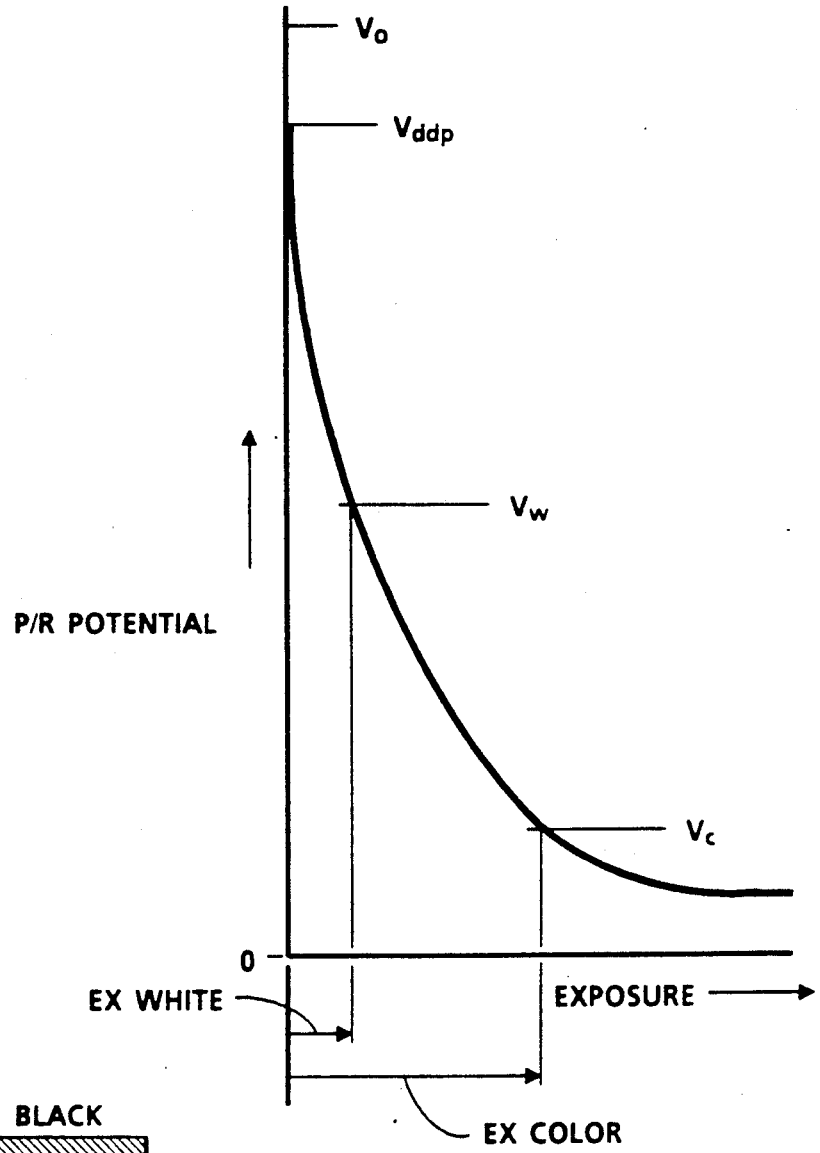
FIG. 1*a* is a plot of photoreceptor potential versus exposure illustrating a tri-level electrostatic latent image.
Figure 1B:
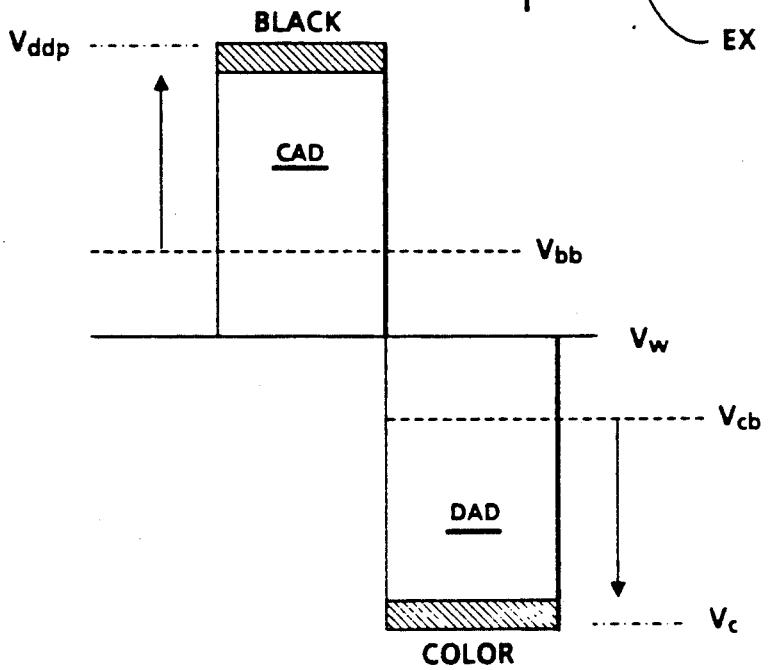
FIG. 1*b* is a plot of photoreceptor potential illustrating singlepass, highlight color latent image characteristics.

For a better understanding of the concept of tri-level imaging, a description thereof will now be made with reference to FIGS. 1*a* and 1*b*. FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_w$, the direction of offset depending on the polarity or sign of toner in the housing. One housing (for the sake of illustration, the second) contains developer with black toner having properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electric field existing between the photoreceptor and the development rolls in the first housing at bias voltage $V_{cb}$ (V color bias).

Figure 2:
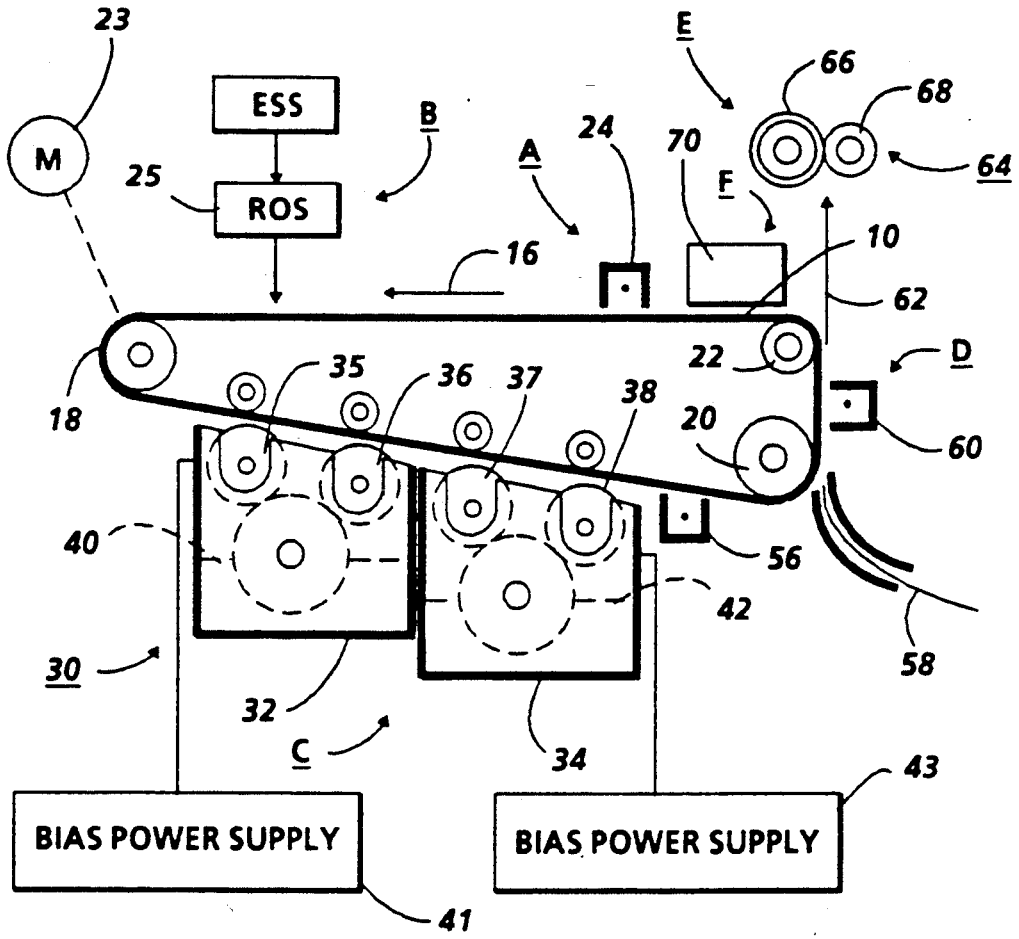
FIG. 2 is schematic illustration of a printing apparatus incorporating the inventive features of our invention.

As shown in FIG. 2, a printing machine incorporating our invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35,36 while a housing 34 contains a pair of magnetic brush rollers 37,38. Each pair of rollers advances its respective developer material into contact with the latent image. Appropriate developer biasing is accomplished via power supplies 41 and 43 electrically connected to respective developer housings 32 and 34.

Figure 3:
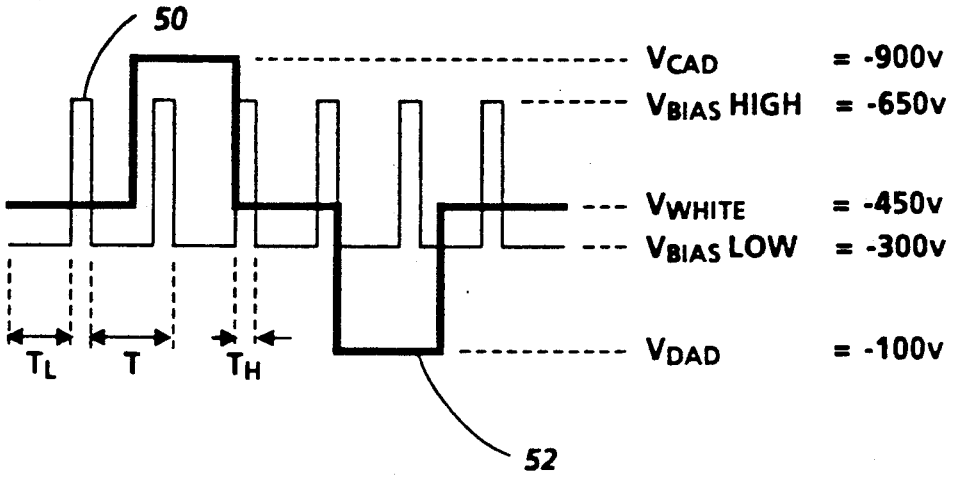
FIG. 3 depicts a tri-level image with a plot of developer bias voltage superimposed thereover which plot illustrates a typical duty cycle for the voltage applied to a DAD developer housing wherein the period for the high bias voltage is approximately 5 to 10% of the total period.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first). contains two-component red conductive magnetic brush developer 40 having triboelectric properties such that the red toner is driven to the least highly charged areas at the potential $V_{DAD}$ of the latent image by the electrostatic field (development field) between the photoreceptor and the development rolls 35,36. These rolls are alternatively biased using a chopped DC bias as shown in FIG. 3 via power supply 41. Conversely, the triboelectric charge on the conductive black magnetic brush developer 42 in the second housing is chosen so that the black toner is urged towards the parts of the latent image at the most highly charged potential $V_{CAD}$ by the electrostatic field (development field) existing between the photoreceptor and the development rolls 37,38. These rolls are alternately using a chopped DC bias as shown in FIG. 4 via power supply 43.

In conventional tri-level imaging as noted above, the CAD and DAD developer housing biases are set at values which are offset from the background voltage by approximately 100 volts. During image development the developer bias voltages are continuously applied. Expressed differently, the biases have a duty cycle of 100%. In accordance with the present invention, a chopped DC (CDC) bias is applied to both the CAD and DAD developer housings. By chopped DC is meant that a first bias voltage is applied for a predetermined period of time and a second predetermined higher voltage is applied for a second period of time which differs from the first time period.

As disclosed in FIG. 3, a waveform 50 depicts the bias voltage according to the present invention for the DAD developer housing 32. The waveform 50 is superimposed upon a typical tri-level image represented by reference character 52. As can be seen from the waveform 50, the DAD bias is alternated between two potentials represented by $V_{Bias}$ High and $V_{Bias}$ Low. Such alternation takes place in a periodic fashion such that the period, $T_H$ for $V_{Bias}$ High equals approximately 6% of the total period, T at a frequency of 5 kHz and the period, $T_L$ is approximately 94% thereof. By way of example, in an operative embodiment of the invention the DC bias levels for $V_{Bias}$ High and $V_{Bias}$ Low are −650 and −300 volts, respectively. The DAD image was recorded at a voltage level of −100 volts while the CAD voltage was at −900 volts with the background at −450 volts.

Figure 4:
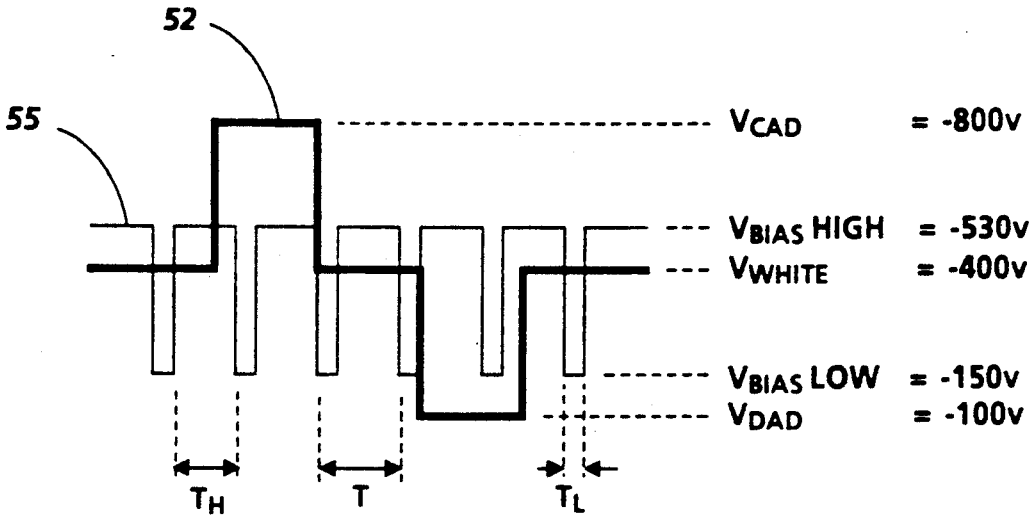
FIG. 4 depicts a tri-level image with a plot of developer bias voltage superimposed thereover which plot illustrates a typical duty cycle for the voltage applied to a CAD developer housing wherein the period for the high bias voltage is approximately 90 to 95% of the total period.

In the case of the CAD image as illustrated in FIG. 4, the bias voltages $V_{Bias}$ High and $V_{Bias}$ Low are −530 and −150 volts, respectively. The waveform 55 representing these biases is inverted with respect to the waveform 50 in the sense that the period, $T_H$ for $V_{Bias}$ High is approximately 94% of the total period, T while the period $T_L$ for $V_{Bias}$ Low is approximately 6% of the total period T.

Developer bias switching between $V_{Bias}$ High and $V_{Bias}$ Low is effected automatically via the power supplies 41 and 43.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

What is claimed is:

1. In the method of developing tri-level latent electrostatic images contained on a charge retentive imaging surface wherein the tri-level images include two image areas at different voltage levels and a background area, the steps of:

providing separate developer structures for developing said two image areas; and alternately applying two voltage biases to one of said developer structures for different periods of time for developing one of said image areas; and alternately applying two voltage biases to the other of said developer structures for different periods of time for developing the second of said image areas.

2. The method according to claim 1 wherein the voltage level of said background area is intermediate the voltage levels of said two image areas.

3. The method according to claim 2 wherein said step of applying one of said voltage biases is effected at a duty cycle of approximately 6%.

4. The method according to claim 3 wherein the frequency of the application of said voltage biases is approximately 5 kHz.

5. The method according to claim 4 wherein one of said image areas is a DAD image.

6. The method according to claim 5 wherein the other of said image areas is a CAD image.

7. The method according to claim 1 wherein said step of applying one of said voltage biases to the other of said developer structures is effected at a duty cycle of approximately 6%.

8. The method according to claim 7 wherein the frequency of the application of said voltage biases applied to said other developer structure is approximately 5 kHz.

9. The method according to claim 8 wherein said image areas and said background area at the same polarity.

* * * * *